US006395445B1

(12) United States Patent
Toth et al.

(10) Patent No.: US 6,395,445 B1
(45) Date of Patent: May 28, 2002

(54) EMULSION AGGREGATION PROCESS FOR FORMING POLYESTER TONERS

(75) Inventors: Alan John Toth, Burlington; Milan Maric, Hamilton, both of (CA); Armin R. Völkel, Palo Alto, CA (US); Marko D. Saban, Etobicoke; Thomas Edward Enright, Tottenham, both of (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/817,192

(22) Filed: Mar. 27, 2001

(51) Int. Cl.[7] ..... G03G 9/087
(52) U.S. Cl. ..... 430/137.14
(58) Field of Search ..... 430/137.14

(56) References Cited

U.S. PATENT DOCUMENTS

| | | | | |
|---|---|---|---|---|
| 5,278,020 | A | | 1/1994 | Grushkin et al. ..... 430/137 |
| 5,290,654 | A | | 3/1994 | Sacripante et al. ..... 430/137 |
| 5,308,734 | A | | 5/1994 | Sacripante et al. ..... 430/137 |
| 5,344,738 | A | | 9/1994 | Kmiecik-Lawrynowicz et al. ..... 430/137 |
| 5,346,797 | A | | 9/1994 | Kmiecik-Lawrynowicz et al. |
| 5,364,729 | A | | 11/1994 | Kmiecik-Lawrynowicz et al. |
| 5,370,963 | A | | 12/1994 | Patel et al. ..... 430/137 |
| 5,403,693 | A | | 4/1995 | Patel et al. ..... 430/137 |
| 5,418,108 | A | | 5/1995 | Kmiecik-Lawrynowicz et al. |
| 5,593,807 | A | | 1/1997 | Sacripante et al. ..... 430/137 |
| 5,853,944 | A | * | 12/1998 | Foucher et al. ..... 430/137 |
| 5,945,245 | A | | 8/1999 | Mychajlowskij et al. |
| 6,120,967 | A | * | 9/2000 | Hopper et al. ..... 430/137.14 |
| 6,143,457 | A | * | 11/2000 | Carlini et al. ..... 430/110.1 |

* cited by examiner

*Primary Examiner*—John Goodrow
(74) *Attorney, Agent, or Firm*—Oliff & Berridge, PLC; Eugene O. Palazzo

(57) ABSTRACT

A process for forming toner particles includes aggregating the toner particles by adding an aggregating agent to a latex emulsion of resin having a colorant mixed therein, the adding being done under adding conditions of agitation and a temperature above a glass transition temperature of the resin, wherein the adding of the aggregating agent comprises first introducing at least about 40% by weight of a total amount of aggregating agent to be added at a rapid introduction rate and subsequently adding a remaining portion of the aggregating agent at a continuous addition rate slower than the rapid introduction rate. The particles are subsequently cooled to a temperature below the glass transition temperature of the resin when particles have been grown to the desired size.

30 Claims, 3 Drawing Sheets

EMULSION AGGREGATION PROCESS FOR FORMING POLYESTER TONERS

BACKGROUND OF THE INVENTION

1. Field of Invention

The invention relates to a process for forming a polyester toner, and more specifically to an aggregation and coalescence process for the preparation of polyester toner compositions. More in particular, the invention relates to a method of preparing a polyester toner composition by the emulsion aggregation technique in which the aggregating agent is added into the composition in stages instead of at a constant addition rate throughout the particle aggregation step.

2. Description of Related Art

In reprographic technologies, such as xerographic and ionographic devices, toners with volume average diameter particle sizes of from about 9 microns to about 20 microns are effectively utilized. However, in xerographic technologies, such as the high volume Xerox Corporation 5090 copier-duplicator, high resolution characteristics and low image noise are highly desired, and can be attained utilizing smaller sized toners having, for example, a volume average particle diameter of from about 2 to about 11 microns and preferably less than about 7 microns, and with a narrow geometric size distribution (GSD) of from about 1.1 to about 1.3. Additionally, in xerographic systems wherein process color is utilized, such as pictorial color applications, small particle size colored toners, preferably of from about 3 to about 9 microns, are desired to avoid, or minimize paper curling. Also, it is preferable to select small toner particle sizes, such as from about 1 to about 7 microns, and with higher colorant loading, such as from about 5 to about 12 percent by weight of toner, such that the mass of toner layers deposited onto paper is reduced to obtain the same quality of image and resulting in a thinner plastic toner layer on paper after fusing, thereby minimizing or avoiding paper curling.

Numerous processes are known for the preparation of toners, such as, for example, conventional polyester processes wherein a resin is melt kneaded or extruded with a pigment, micronized and pulverized to provide toner particles of the desired volume average particle diameter and geometric size distribution. In such processes, wherein large materials are mechanically reduced in size to achieve the desired smaller toner particles, it is usually necessary to subject the aforementioned toners to a classification procedure such that the desired size and geometric size distribution is attained. Also, in the aforementioned conventional process, low toner yields after classification may be obtained. For example, during the preparation of toners with average particle size diameters of from about 11 microns to about 15 microns, toner yields range from about 70 percent to about 85 percent after classification, and during the preparation of smaller sized toners with particle sizes of from about 7 microns to about 10 microns, lower toner yields may be obtained after classification, such as from about 50 percent to about 70 percent.

As an improvement to the foregoing mechanical reduction processes, processes are known in which the toner is achieved via aggregation as opposed to particle size reduction. For example, emulsion/aggregation/coalescing processes for the preparation of toners are illustrated in a number of Xerox patents, the disclosures of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797. Also of interest may be U.S. Pat. Nos. 5,348,832, 5,405,728, 5,366,841, 5,496,676, 5,527,658, 5,585,215, 5,650,255, 5,650,256 and 5,501,935. In these methods, the toners are formed chemically in situ and do not require known pulverization and/or classification methods.

Illustrated in U.S. Pat. No. 5,593,807, the disclosure of which is totally incorporated herein by reference in its entirety, is a process for the preparation of toner compositions comprising, for example, (i) preparing an emulsion latex comprised of sodio sulfonated polyester resin particles of from about 5 to about 500 nanometers in size diameter by heating the resin in water at a temperature of from about 65° C. to about 90° C.; (ii) preparing a pigment dispersion in water by dispersing in water from about 10 to about 25 weight percent of sodio sulfonated polyester and from about 1 to about 5 weight percent of pigment; (iii) adding the pigment dispersion to the latex mixture with shearing, followed by the addition of an alkali halide in water until aggregation results as indicated, for example, by an increase in the latex viscosity of from about 2 centipoise to about 100 centipoise; (iv) heating the resulting mixture at a temperature of from about 45° C. to about 55° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying. The sulfonated polyesters of this patent may be selected for the processes of the present invention.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites. The appropriate polyesters of this patent may be selected for the processes of the present invention.

U.S. Pat. No. 5,945,245, the disclosure of which is totally incorporated herein by reference in its entirety, describes a surfactant free process for the preparation of toner comprising heating a mixture of an emulsion latex, a colorant, and an organic complexing agent. The process may comprise (i) preparing an emulsion latex comprised of sodio sulfonated polyester resin particles of from about 5 to about 300 nanometers in size diameter by heating the resin in water at a temperature of from about 65° C. to about 90° C.; (ii) adding with shearing to the latex a colorant dispersion containing from about 20 to about 50 percent of predispersed colorant in water and with a mean colorant size range of from about 50 to about 150 nanometers, followed by the addition of an organic complexing agent; (iii) heating the resulting mixture at a temperature of from about 45° C. to about 65° C. thereby causing aggregation and enabling coalescence, resulting in toner particles of from about 2 to about 20 microns in volume average diameter; and (iv) cooling the toner product mixture followed by isolation, and drying. The organic complexing agent may be 1,4-diaminobutane, 1,4-diaminocyclohexane, 1,7-diaminoheptane, 1,6-diaminohexane, 1,2-diamino-2-methylpropane, 1,9-diaminononane, 1,8-diaminooctane, 1,5-diaminopentane, 1,2-diaminopropane, 1,3-diaminopropane, 1,3-diamino-2-hydroxypropane, ethanolamine, triethylamine, or tripropylamine.

Methods for forming toners by the aggregation process have included the method wherein during the aggregation step, the aggregating agent is added via a slow, steady continuous addition. Such process achieves toner particles of the desired size and geometric size distribution, but takes a substantial amount of time to complete. For example, particle growth times of from about 11 to about 15 hours are needed.

What is still needed is an improved process for forming toner particles in a much shorter amount of time, thereby improving the economic feasibility of the process, and with less total coarse particles and fouling.

SUMMARY OF THE INVENTION

It is thus an object of the present invention to develop an improved method for making toner particles in which the time for obtaining the particle growth is significantly reduced over similar known aggregation processes.

It is a still further object of the present invention to develop a method of forming toner particles in which a narrow geometric size distribution is achieved with less total amount of coarse particles.

It is a still further object of the present invention to develop a method of forming toner particles that results in little or no fouling.

These and other objects of the present invention are achieved by the present invention, wherein a two stage addition of an aggregating agent is effected during the aggregation of the toner particles. In particular, an amount of the aggregating agent is first rapidly introduced into a resin/colorant mixture, and then a remaining portion of the aggregating agent is added at a slower continuous addition rate.

In a first embodiment, the invention relates to a process for forming toner particles, comprising aggregating the toner particles by adding an aggregating agent to a latex emulsion of resin having a colorant mixed therein, the adding being done under adding conditions of agitation and a temperature above a glass transition temperature of the resin, wherein the adding of the aggregating agent comprises first introducing at least about 40% by weight of a total amount of aggregating agent to be added at a rapid introduction rate and subsequently adding a remaining portion of the aggregating agent at a continuous addition rate slower than the rapid introduction rate, and subsequently cooling a product mixture obtained to a temperature below the glass transition temperature of the resin.

In another embodiment, the invention relates to a process for forming toner particles, comprising (i) preparing a latex emulsion of resin particles by heating the resin in water at a temperature above a glass transition temperature of the resin, (ii) preparing a colorant dispersion by dispersing a colorant in water, (iii) adding the colorant dispersion to the latex emulsion with agitation, (iv) subsequently adding an aggregating agent to the latex emulsion of resin having the pigment dispersion mixed therein, the adding being done under adding conditions of agitation and a temperature above a glass transition temperature of the resin, wherein the adding of the aggregating agent comprises first introducing at least about 40% by weight of a total amount of aggregating agent to be added at a rapid introduction rate and subsequently adding a remaining portion of the aggregating agent at a continuous addition rate slower than the rapid introduction rate, and (v) subsequently cooling a product mixture obtained to a temperature below the glass transition temperature of the resin.

DETAILED DESCRIPTION OF PREFERRED EMBODIMENTS

Figure 1:
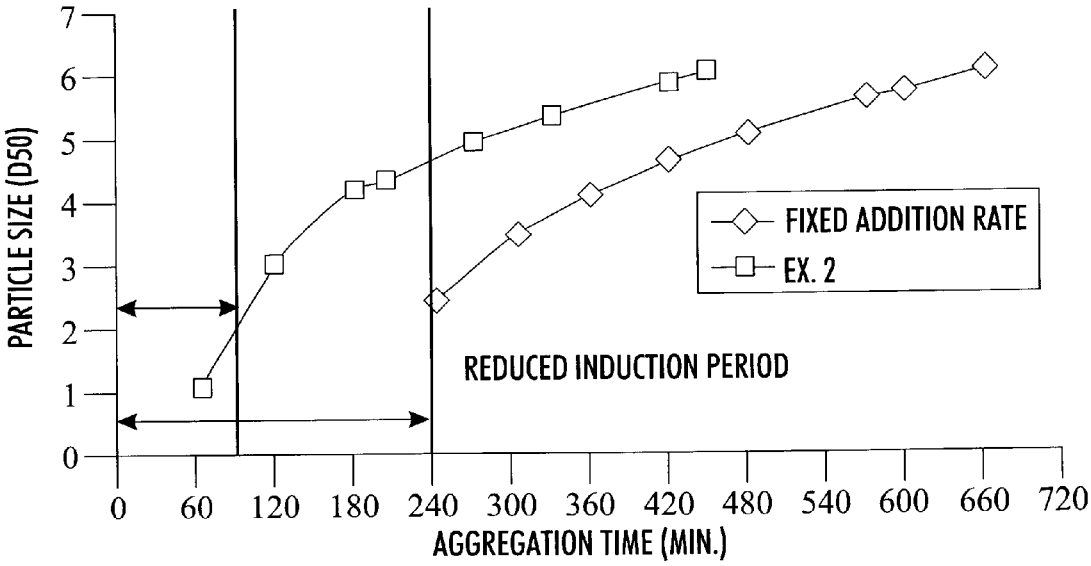
FIGS. 1 and 3 graphically summarize particle size versus time of the aggregation period for experiments of the invention and a comparative experiment.

The present invention is generally directed to toner processes, and more specifically, to aggregation processes for the preparation of toner compositions. In embodiments, the present invention is directed to the economical chemical in situ preparation of toners without known pulverization and/or classification methods, and wherein in embodiments toner compositions with a volume average diameter of from about 1 to about 15, preferably from 1 to about 10 microns and more preferably from about 3 to about 7 microns, and narrow GSD of, for example, from about 1.10 to about 1.25, preferably from about 1.10 to about 1.20, as measured on the Coulter Counter can be obtained.

The resulting toners can be selected for known electrophotographic imaging, digital, printing processes, including color processes, and lithography. The toners obtained are especially useful for the development of colored images with excellent line and solid resolution, and wherein substantially no background deposits are present.

The present invention is directed to an improved method of aggregating toner particles by adding an aggregating agent to a latex emulsion of resin having a colorant mixed therein, the adding being done under adding conditions of agitation and a temperature above a glass transition temperature of the resin, wherein the adding of the aggregating agent comprises first introducing at least about 40% by weight, preferably about 40% to about 80% by weight, more preferably about 50% to about 80% by weight, most preferably about 60% to about 80% by weight, of a total amount of aggregating agent to be added at a rapid introduction rate and subsequently adding a remaining portion of the aggregating agent at a continuous addition rate slower than the rapid introduction rate. The toner particles can be subsequently cooled to a temperature below the glass transition temperature of the resin and collected.

The process of the present invention is a surfactant free chemical method wherein polyester particles, preferably sulfopolyester particles, are aggregated with an ionic salt aggregating agent, preferably zinc acetate, under controlled mixing conditions.

In the process of the invention, the aggregating agent is added into a mixture of a latex emulsion of the toner binder resin and a colorant dispersion.

The latex emulsion of binder resin may be formed by forming a latex of a polyester, such as a sodium sulfonated polyester, resin in water with heating the resin in water at a temperature of from, for example, about 45° C. to about 90° C. The polyester resin selected preferably contains sulfonated groups thereby rendering them dissipatable, that is, they form spontaneous emulsions in water without the use of organic solvents, especially above the glass transition temperature, Tg, of the polyester resin. The latex of suspended polyester resin particles is comprised of particles which have an average size of from, for example, about 5 to about 500 nm and more preferably about 10 to about 250 nm in volume average diameter, as measured by any suitable device such as, for example, a NiComp sizer. The polyester particles preferably comprise, for example, about 5 to about 40 percent by weight of the latex emulsion.

The polyester, most preferably a sulfonated polyester, may be formed from any suitable acid and alcohol. Preferably, the polyester is derived from one or more terephthalates and one or more glycols. For example, the polyester may be derived from a reaction that includes, for example, three glycol components. In a most preferred embodiment herein, the polyester is a sulfonated polyester derived from a reaction of dimethylterephthalate, sodium dimethyl 5-sulfoisophthalate, propanediol, diethylene glycol and dipropylene glycol.

Additional examples of sulfonated polyesters which may be used in the present invention include those illustrated in U.S. Pat. Nos. 5,593,807 and 5,945,245, the disclosures of which are totally incorporated herein by reference, for example including sodium sulfonated polyester, and more specifically, a polyester such as poly(1,2-propylene-sodio 5-sulfoisophthalate), poly(neopentylene-sodio 5-sulfoisophthalate), poly(diethylene-sodio 5-sulfoisophthalate), copoly(1,2-propylene-sodio 5-sulfoisophthalate)-copoly-(1,2-propylene-terephthalate-phthalate), copoly(1,2-propylene-diethylene-sodio 5-sulfoisophthalate)-copoly-(1,2-propylene-diethylene-terephthalate-phthalate), copoly(ethylene-neopentylene-sodio 5-sulfoisophthalate)-copoly-(ethylene-neopentylene-terephthalate-phthalate), and copoly(propoxylated bisphenol A)-copoly-(propoxylated bisphenol A-sodio 5-sulfoisophthalate).

The sulfonated polyesters may in embodiments be represented by the following formula, or random copolymers thereof wherein the n and p segments are separated.

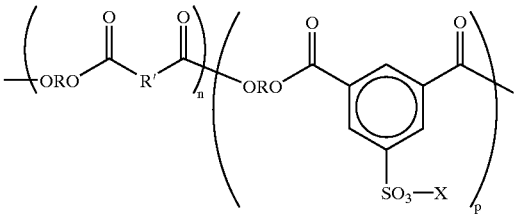

wherein R is an alkylene of, for example, from 2 to about 25 carbon atoms such as ethylene, propylene, butylene, oxyalkylene diethyleneoxide, and the like; R' is an arylene of, for example, from about 6 to about 36 carbon atoms, such as a benzylene, bisphenylene, bis(alkyloxy) bisphenolene, and the like; and p and n represent the number of randomly repeating segments, such as for example from about 10 to about 10,000. The alkali sulfopolyester possesses, for example, a number average molecular weight (Mn) of from about 1,500 to about 50,000 grams per mole and a weight average molecular weight (Mw) of from about 6,000 grams per mole to about 150,000 grams per mole as measured by gel permeation chromatography and using polystyrene as standards.

To this latex emulsion of binder is added, with controlled agitation/mixing, a colorant dispersion containing, for example, about 5 to about 50 percent of predispersed colorant in water. The colorant may be, for example, dyes, pigments, mixtures thereof, mixtures of pigments, mixtures of dyes, and the like, although the use of pigments and pigment mixtures is preferred. The colorant may have a color of, for example, black (e.g., carbon black), cyan, yellow, magenta, or mixtures thereof. The colorant preferably has a mean colorant size ranging from about 50 to about 150 nanometers.

Various known colorants or pigments are present in the toner in an effective amount of, for example, from about 1 to about 25 percent by weight of the toner, and preferably in an amount of from about 1 to about 15 weight percent of the toner. A suitable black pigment that may be used is, for example, carbon black like REGAL 330™ and the like. As colored pigments, there can be selected pigments of cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In most preferred embodiments of the invention, the colorant is comprised of a predispersed pigment such as are commercially available. Although dry pigments may be used in the invention, additional processing requirements, for example including the use of a homogenizer, may be needed in forming the toner. The use of predispersed pigment dispersions avoids the need for such additional processing requirements. Example preferred pigment dispersions include, for example, the FLEXIVERSE series and the SUNSPERSE series of pigment dispersions from Sun Chemical. Some of these are Blue 15:3 (BFD-1121), Blue 15 (BFD-1149), Blue 61 (BFD-9516), Red 81:2 (RFD 9664), Red 22 (RFD-4241), Yellow 14 (YFD-1123), Yellow 17 (YFD-4249), Black Regal 660 (LFD-4343), Green 7 (GFD-1151), Green 36 (GHD-7114), Violet 19 (QFD-1180) and Violet 23 (VFD-1157).

These colorants, especially pigments, selected are present in various effective amounts, and generally from about 1 weight percent to about 65 weight and preferably from about 2 to about 12 percent, of the toner.

In some instances, colorants, such as pigments available in the wet cake form or concentrated form containing water, can be easily dispersed utilizing a homogenizer or stirring. In other embodiments, pigments are available in a dry form, whereby a dispersion in water is preferably effected by, for example, microfluidizing using, for example, an M-110 microfluidizer and passing the pigment dispersion from about 1 to about 10 times through the chamber of the microfluidizer, or by sonication, such as using a Branson 700 sonicator, or by a rotor-stator type of in-line homogenizer, for example, IKA or Quaddro and Kady Mill batch homogenizer.

Once the colorant dispersion has been added to the latex emulsion of resin, the aggregation process is begun by introducing an initial portion of the aggregating agent into the mixture. The adding of the aggregating agent is preferably conducted under conditions of agitation and a temperature above a glass transition temperature of the resin. Most preferably, the agitation is stirring or shearing effected by use of stirring impeller (agitator) blades in the vessel. The agitation may be conducted at from, for example, about 75 revolutions per minute to about 350 revolutions per minute, the faster speeds applying to lower sized reaction vessels. For example, the agitation in the vessels may be from about 75 RPM for a 300 gallon reactor, about 110 RPM for a 30 gallon reactor, about 135 RPM for a 20 gallon reactor, about 160 RPM for a 5 gallon reactor, up to about 350 RPM for a 2-L Buchi reactor. The 2-L Buchi may be run at up to about 700 RPM. The temperature is achieved by heating to a temperature above the glass transition of the resin. Preferably, the temperature is from about 10° C. to about 40° C. above the glass transition temperature of the resin. For the preferred sodium sulfonated polyester resins of the invention, the temperature is preferably from about 45° C. to about 100° C.

The aggregating agent is added into the mixture in the aggregation step in two distinct phases. In the first phase, a portion of the aggregating agent comprising at least about 40% by weight, and most preferably from about 60 to about 80 percent by weight, of the total amount of aggregating agent to be added is rapidly introduced into the mixture. This is accomplished by, for example, rapid metering of the aggregating agent into the mixture in the vessel. As an example, a metering rate of about 5 to about 50 ml/min for a 2 L vessel may be used. Most preferably, a suitable metering rate for the first phase of the introduction of the aggregating agent is selected such that the desired portion of the aggregating agent is added into the vessel in about 1 to about 40 minutes, preferably about 10 to about 30 minutes, from the start of the addition.

Following the first rapid phase of introducing the aggregating agent, the remaining portion of the aggregating agent to be introduced is added into the vessel at a much slower rate of addition. For example, a metering rate of from about 2 ml/mn or less for a 2 L vessel can be used. The total time to add the remaining portion of the aggregating agent in this second phase may be on the order of from, for example, about 1 hour to about 7 hours. While the addition rate in this second stage is preferably held constant until the remaining portion of the aggregating agent is added into the vessel, it may also be varied as desired during the second phase of addition.

The total amount of aggregating agent required for the aggregation is from, for example, about 5% to about 20% by weight of resin in the emulsion. The aggregating agent is preferably added as a solution in water, the solution containing on the order of, for example, about 1% to about 20% by weight of the aggregating agent. The water is most preferably deionized water.

In a preferred embodiment of the present invention, dilute solutions of aggregating agent are used to optimize particle aggregation time with as little fouling and coarse particle formation as possible. For example, fouling may be decreased to <0.1% when a 1% to 10%, preferably 3% to 5%, zinc acetate solution is used as the aggregating agent solution. Thus, the aggregating agent solution preferably contains 5% by weight or less aggregating agent, preferably 3% by weight or less. Further, it may be possible to add a dip tube into the vessel in order to reduce foaming and more intimately mix the aggregating agent with the resin particles, and thus further eliminate fouling.

In a most preferred embodiment of the present invention, the aggregating agent is zinc acetate. When zinc acetate is used as the aggregating agent, addition of the zinc acetate causes complexation between the $Zn^{2+}$ ions and the $SO^{3-}$ ions on the resin. The close contact, temperature and ionic strength of the media cause the particles to aggregate into larger particles. Particle growth stops by cooling the slurry to a temperature below the resin Tg.

Any other aggregating agent capable of causing complexation as discussed above might also suitably be used. Both alkali earth metal or transition metal salts can be utilized as aggregating agents. Examples of the alkali (II) salts that can be selected to aggregate the sodio sulfonated polyester colloid with a colorant to enable the formation of the toner composite are preferably selected from beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, and barium iodide. Examples of transition metal salts or anions include acetates, acetoacetates, sulfates of vanadium, niobium, tantalum, chromium, molybdenum, tungsten, manganese, iron, ruthenium, cobalt, nickel, copper, zinc, cadmium, silver or aluminum salts such as aluminum acetate, aluminum polyaluminum chloride, aluminum halides, mixtures thereof and the like, and wherein the concentration thereof is optionally in the range of from about 0.1 to about 5 weight percent by weight of water. It is believed that the alkali (II) or transition metal ion exchanges with the monovalent sodium ion of the sulfonated polyester resin colloid.

The process of the present invention can be considered a substantially surfactant free chemical method wherein sulfopolyester particles are aggregated with aggregating agents in the presence of a colorant dispersion by heating wherein during the heating no surfactants are utilized. The process generates toner size particles with, for example, an average particle volume diameter of from about 1 to about 15 and preferably about 3 to about 7 microns as determined by, for example, a Coulter Counter. It is believed that during the heating, the components of the sulfonated polyester latex and the colorant dispersion aggregate and fuse together to form composite toner particles. The size of the particles can be controlled by, for example, the amount of aggregating agent added and by the temperature of heating.

Following addition of all of the aggregating agent into the vessel, the aggregation step conditions (stirring and heating) may be continued for a period of time until toner particles of the desired size and size distribution are obtained. The size may be monitored by taking samples from the vessel and evaluating the size of the toner particles, for example with a Coulter Counter.

The particles obtained after the aggregation step can be subjected to washing/rinsing with, for example, water to remove residual aggregating agent, and drying, whereby there are obtained toner particles comprised of resin and colorant. In addition, the toner particles may be subjected to screening and/or filtration steps to remove undesired coarse particles from the toner.

In a most preferred embodiment of the present invention, a 3% by weight zinc acetate solution is used as the aggregating agent, with about 70% added in the rapid initial addition phase of aggregation, with the aggregating agent being added above the liquid level in the vessel. Further a reaction temperature of 58° C., a reaction pressure of atmospheric and an agitation rate of 275 rpm with 2 impellers is preferred. This combination of factors results in the low fouling (<0.1%), relatively low coarse particles (less than 3 wt. %), and a reasonable reaction time (~6 hours).

Surface additives may be added to the toner particles after isolation by, for example, filtration, and then optionally followed by washing and drying. Suitable external surface additives include, for example, metal salts, metal salts of fatty acids, colloidal silicas, titanium oxides, mixtures thereof, and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate, silicas, such as AEROSIL R972®, and other silicas available from Cabot Corporation Degussa Company. These additives can be selected in amounts of, for example, from about 0.1 to about 2 percent, and which additives can be incorporated during the aggregation, or blended into the formed toner product. The toner may also include known charge additives in effective amounts of, for example, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of each of these patents being totally incorporated herein by reference, negative charge enhancing additives like aluminum complexes, and the like. Other known positive and negative enhancing charge additives may also be selected.

The process of the present invention can be used to produce toner particles within any sized reactor, and is thus commercially significant. Scaling up of the process from bench reactors to larger reactors can be readily achieved by practitioners in the art. One preferred scale-up rule herein is based upon matching the power/volume requirements for the two reactors. Such a scale-up rule effectively predicts the required agitation rate even when using different impellers or different number of impellers.

This invention thus describes a new process for the aggregation of polyester particles by quickly adding up to, for example, 40–80% of the total aggregating agent, e.g., zinc acetate solution, in the first minutes of the aggregation. This fast initial addition is continued until at least 40% or more of the target amount of aggregating agent is added to the resin/colorant dispersion in deionized water, thereby achieving the needed concentration of aggregating agent needed for fast, but controlled, aggregation. The remaining aggregating agent is then added slowly at a fixed rate, growing particles to the desired size.

The aggregation process of the present invention has many advantages when compared to a slow continuous addition of the aggregating agent solution. The advantages include (1) much faster aggregation time (the process decreases the time needed to achieve the target particle size by 40–50%, for example to between about 3 and about 7 hours); (2) narrow particle size distribution is retained (less than 1.2 GSD as determined by Coulter Counter); (3) excellent reproducibility; (4) the amount of total coarse and fouled material is decreased by more than 40% compared to slow steady addition; (5) the toner yield is increased; and (6) a one work shift aggregation process is enabled. Additional advantages also include that the solids content is significantly higher, at about 12%, from 1% to 5% as described in U.S. Pat. No. 5,593,807, which is obviously important for overall process economics; the useful temperature range for particle growth is 45° C. to 65° C. (rather than the more restricted 45° C. to 55° C.); the resin latex can be prepared separately from the particles, stored almost indefinitely, and used on demand for the particles growth; and the latex particle size range is from 10–150 nanometer compared to (rather than the larger 50–150 nm prior art range).

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 15 percent toner concentration. The carrier particles may also be comprised of a carrier core with a polymer coating, or coatings thereover, and dispersed therein a conductive component like a conductive carbon black in an amount, for example, of from about 5 to about 60 weight percent.

The following Examples are provided to further illustrate embodiments of the present invention.

EXAMPLE 1

A sulfonated polyester resin and emulsion thereof is prepared as follows. Dimethylterephthalate (715.0 grams), sodium dimethyl 5-sulfoisophthalate (95.8 grams), propanediol (526.0 grams), diethylene glycol (48.0 grams), dipropylene glycol (247.1 grams), and butyltin hydroxide catalyst (1.5 grams) are charged to a 2-Liter Hoppes polycondensation reactor, equipped with a heating jacket, mechanical stirrer with anchor, thermowell, reflux and take-off condenser. The mixture is heated to 190° C., and the temperature is allowed to slowly increase to about 200° C. to 202° C. while the methanol byproduct is collected in a distillation receiver. The temperature is then raised to about 210° C. as the pressure is reduced from atmospheric to about 8 mm Hg over a period of about 4.5 hours. During this time, excess glycol is collected in the distilling receiver. The product is discharged through a bottom drain valve to result in the product with an onset glass transition temperature of 53.8° C.

168 grams of the above polyester resin is then added to 1232 grams of deionized water at 92° C. with stirring for 2 hours to provide an emulsion of sulfonated polyester particles in water.

EXAMPLE 2

An emulsion consisting of 12% sulfonated polyester in deionized water is prepared in a 20 gallon reactor by adding 12% (by wt.) of the polyester resin into deionized water at 85–90° C. The particle size of the emulsion is typically 22 nm measured by a NiComp sizer.

In a stainless steel 2-liter Buchi reactor equipped with 2 stirring blades (P4/45°), 2 baffles, and with heating supplied by an outside bath to the jacket of the reactor, is added 1,400 g of the polyester emulsion, and 14.22 g of Flexiverse® blue 15:3 color pigment dispersion by Sun Chemical Company.

A solution of 5% zinc acetate in deionized water is prepared by dissolving zinc acetate at room temperature in a beaker with magnetic stirring. This solution is added to a reservoir that is placed onto a balance and connected to a pump capable of accurately dispensing the zinc acetate solution between 0.0 and 9.9 ml/min. The amount of zinc acetate required for the aggregation is 10% of the weight of resin in the emulsion.

The emulsion/dispersion is heated to 56° C., and the stirring is adjusted to 350 rpm by tachometer. To start the aggregation, the pump to the zinc acetate solution is started at 9.9 ml/min. The amount of zinc acetate in the aggregation is measured by the weight loss on the balance. When 60% of the total zinc acetate is added (205 g of 5% solution), the pump addition rate is reduced to 1.1 ml/min and the addition is continued until the amount of zinc acetate equals 10% of the resin in the emulsion (335 g of 5% solution).

Samples are taken during the run and tested on a Coulter Counter for particle size and particle size distribution. When the particle size is 6 μm and the geometric size distribution (GSD) less than 1.2, the aggregation is stopped by lowering the temperature in the reactor to room temperature. The particles are then discharged and screened through 150 and 38-μm sieves to remove coarse material, and then collected by filtration on a 5-μm polypropylene filter cloth. The particles are then rinsed and washed 2 times. Testing the filtrates for conductivity, the final conductivity is 23.4 μS. The toner particles are dried in a vacuum oven for 64 hours at room temperature. Fouled material is scraped from the reactor interior. The coarse and fouled material is then also dried and weighed to determine the mass balance.

Comparative Example 1

For comparative purposes, Example 2 is repeated except using a steady fixed rate addition of the 5% zinc acetate solution at 1.1 g/min, for 5 hours, with continuous stirring at 350 rpm.

Figure 2:
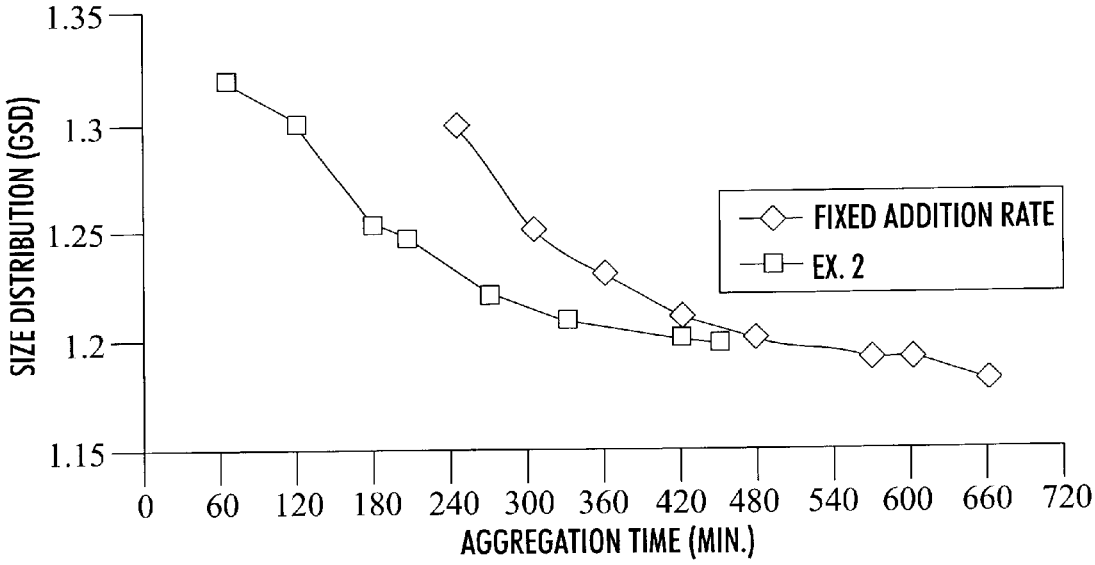
FIGS. 2 and 4 graphically summarize particle size distribution versus time of the aggregation period for experiments of the invention and a comparative experiment.

FIGS. 1 and 2 show the results of Example 2 and Comparative Example 1. In FIG. 1, the results of the experiments are compared for particle size over the aggregation period, while in FIG. 2, the results are compared for particle size distribution over the aggregation period.

In FIG. 1 it is seen that by quickly reaching the critical aggregation concentration in Example 2 via the initial rapid addition of the aggregating agent, significant aggregation occurs within the first 2 hours. When the zinc acetate is added slowly at a fixed rate in the Comparative Example 1, in excess of 4 hours is needed to grow to the same size. Total time needed to achieve 6 μm particles in Example 2 is 7.5 hours compared to 11 hours in the fixed addition of Comparative Example 1. This process improvement demonstrates a decrease of 32% in the time needed to aggregate 6 μm particles. The geometric size distribution target of 1.2 is obtained in both cases.

EXAMPLE 3

In this Example 3, Example 2 is repeated but improved by increasing the aggregation temperature to 58° C., and stirring during the fast zinc acetate addition is increased to 700 rpm for faster dispersion, later decreasing the rpm to 350 rpm for the slow zinc acetate addition and throughout the rest of the aggregation.

Figure 3:
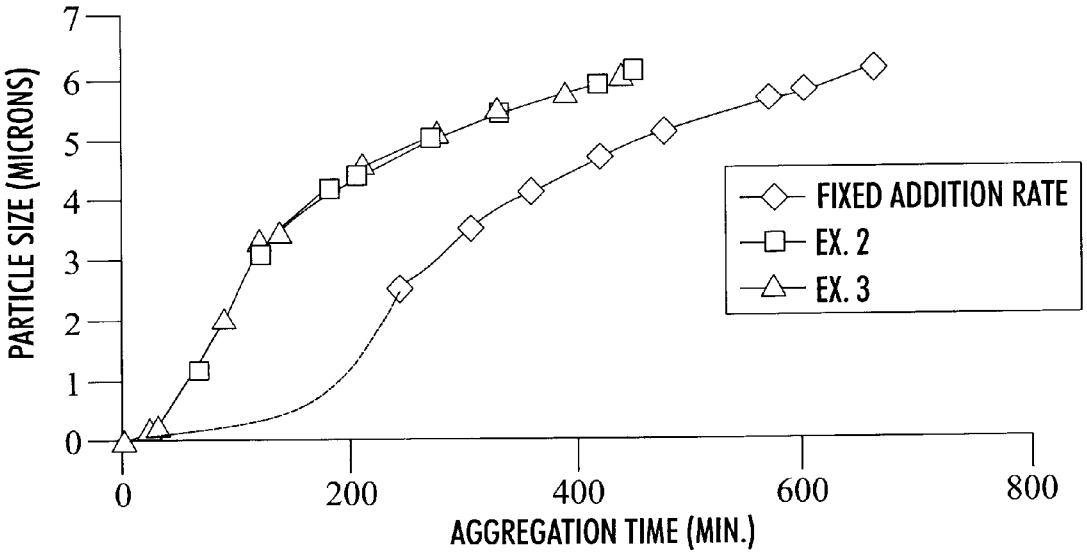
Figure 4:
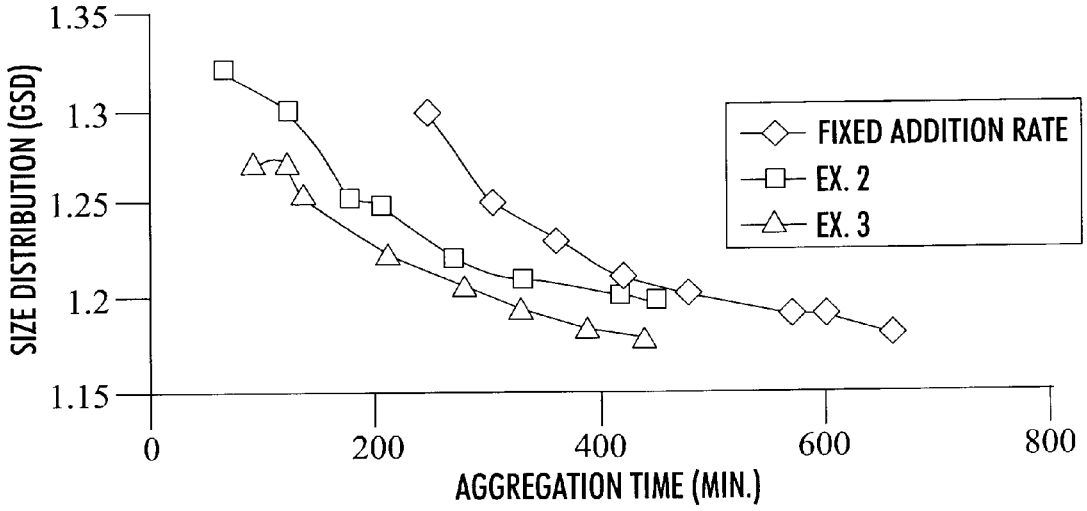

FIGS. 3 and 4 are similar to FIGS. 1 and 2, but include the results from Example 3. In FIG. 3 it is seen that the particle size growth is identical to Example 1, demonstrating reproducibility despite increased stirring speed during the fast zinc acetate addition. In FIG. 4 it is seen that the increased stirring rate during the fast zinc acetate addition narrows the geometric size distribution value equal to or less than the specification of 1.2.

Figure 5:
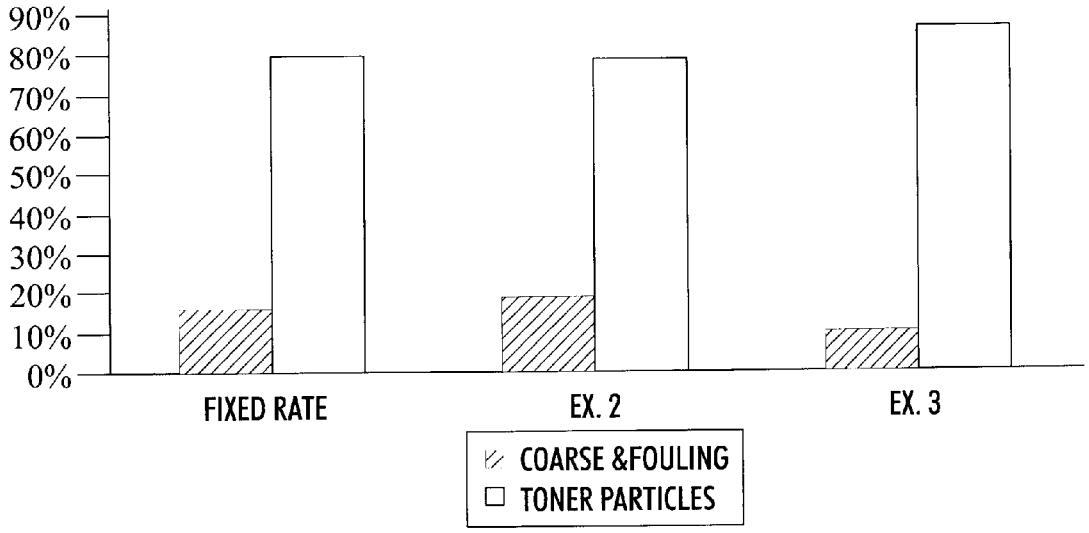
FIG. 5 graphically summarizes the amount of coarse and fouled material for experiments of the invention and a comparative experiment.

FIG. 5 shows that the amount of coarse and fouled material is greatly reduced from 15.1% to 8.4% using the aggregation process of Example 3. This is a decrease of 44%. Yield of toner particles is increased from 79.8% to 85.2%.

Although the invention has been described with reference to specific preferred embodiments, it is not intended to be limited solely thereto. Rather, those having ordinary skill in the art will recognize that variations and modifications may be made therein which are within the spirit of the invention and within the scope of the claims.

What is claimed is:

1. A process for forming toner particles, comprising aggregating the toner particles by adding an aggregating agent to a latex emulsion of resin having a colorant mixed therein, the adding being done under adding conditions of agitation and a temperature above a glass transition temperature of the resin, wherein the adding of the aggregating agent comprises first introducing from about 40% to about 80% by weight of a total amount of aggregating agent to be added at a rapid introduction rate and subsequently adding a remaining portion of the aggregating agent at a continuous addition rate slower than the rapid introduction rate, and subsequently cooling a product mixture obtained to a temperature below the glass transition temperature of the resin, wherein the resin is a polyester resin.

2. The process according to claim 1, wherein following the addition of the remaining portion of the aggregating agent, the adding conditions are continued until toner particles of a desired aggregation size are obtained.

3. The process according to claim 2, wherein the desired aggregation size is from about 3 to about 7 microns in volume average diameter.

4. The process according to claim 1, wherein the process is conducted in the absence of surfactants.

5. The process according to claim 1, wherein the polyester resin is a sodium sulfonated polyester resin.

6. The process according to claim 5, wherein the sodium sulfonated polyester is prepared from a reaction of dimethylterephthalate, sodium dimethyl 5-sulfoisophthalate, propanediol, diethylene glycol and dipropylene glycol.

7. The process according to claim 1, wherein the aggregating agent is zinc acetate.

8. The process according to claim 1, wherein the amount of aggregating agent rapidly introduced is from about 60% to about 80% by weight of the total amount of aggregating agent to be added.

9. The process according to claim 1, wherein the first rapid introduction of the aggregating agent is completed in about 1 to about 40 minutes from a start of addition.

10. The process according to claim 1, wherein the subsequent adding of the remaining portion of the aggregating agent takes a total time of from about 1 hour to about 7 hours.

11. The process according to claim 1, wherein the aggregating agent is added as a solution in water containing about 1% to about 20% by weight of the aggregating agent.

12. The process according to claim 1, wherein following the cooling, the process further comprises rinsing and drying the toner particles and optional screening of the toner particles to remove coarse particles.

13. The process according to claim 1, wherein the colorant is pigment.

14. The process according to claim 1, wherein the temperature of the adding is from about 45° C. to about 100° C.

15. The process according to claim 1, wherein the agitation comprises shearing with agitator blades.

16. A process for forming toner particles, comprising (i) preparing a latex emulsion of resin particles by heating the resin in water at a temperature above a glass transition temperature of the resin, (ii) preparing a colorant dispersion by dispersing a colorant in water, (iii) adding the colorant dispersion to the latex emulsion with agitation, (iv) subsequently adding an aggregating agent to the latex emulsion of resin having the colorant dispersion mixed therein, the adding being done under adding conditions of agitation and a temperature above a glass transition temperature of the resin, wherein the adding of the aggregating agent comprises first introducing from about 40% to about 80% by weight of a total amount of aggregating agent to be added at a rapid introduction rate and subsequently adding a remaining portion of the aggregating agent at a continuous addition rate slower than the rapid introduction rate, and (v) subsequently cooling a product mixture obtained to a temperature below the glass transition temperature of the resin, wherein the resin is a polyester resin.

17. The process according to claim 16, wherein the colorant dispersion comprises pigment dispersed in water, optionally also containing amounts of the resin of the latex emulsion.

18. The process according to claim 16, wherein following the addition of the remaining portion of the aggregating agent, the adding conditions are continued until toner particles of a desired aggregation size are obtained.

19. The process according to claim 18, wherein the desired aggregation size is from about 3 to about 7 microns in volume average diameter.

20. The process according to claim 16, wherein the process is conducted in the absence of surfactants.

21. The process according to claim 16, wherein the polyester resin is a sodium sulfonated polyester resin.

22. The process according to claim 21, wherein the sodium sulfonated polyester is prepared from a reaction of dimethylterephthalate, sodium dimethyl 5-sulfoisophthalate, propanediol, diethylene glycol and dipropylene glycol.

23. The process according to claim 16, wherein the aggregating agent is zinc acetate.

24. The process according to claim 16, wherein the amount of aggregating agent rapidly introduced is from about 60% to about 80% by weight of the total amount of aggregating agent to be added.

25. The process according to claim 16, wherein the first rapid introduction of the aggregating agent is completed in about 1 to about 40 minutes from a start of addition.

26. The process according to claim 16, wherein the subsequent adding of the remaining portion of the aggregating agent takes a total time of from about 1 hour to about 7 hours.

27. The process according to claim 16, wherein the aggregating agent is added as a solution in water containing about 1% to about 20% by weight of the aggregating agent.

28. The process according to claim 16, wherein following the cooling, the process further comprises rinsing and drying the toner particles and optional screening of the toner particles to remove coarse particles.

29. The process according to claim 16, wherein the temperature of the adding is from about 45° C. to about 100° C.

30. The process according to claim 16, wherein the agitation comprises shearing with agitator blades.

* * * * *